US007686636B2

(12) United States Patent
Lin

(10) Patent No.: US 7,686,636 B2
(45) Date of Patent: Mar. 30, 2010

(54) SOCKET CONNECTOR HAVING LEVER-ENGAGING MEMBER

(75) Inventor: Chun-Fu Lin, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/228,734

(22) Filed: Aug. 14, 2008

(65) Prior Publication Data

US 2009/0047820 A1 Feb. 19, 2009

(30) Foreign Application Priority Data

Aug. 14, 2007 (TW) ..... 96213371 U

(51) Int. Cl.
*H01R 11/22* (2006.01)

(52) U.S. Cl. ..... 439/266; 439/331; 439/73

(58) Field of Classification Search ..... 439/346, 439/342, 259, 266, 331, 73
See application file for complete search history.

(56) References Cited

U.S. PATENT DOCUMENTS 6,371,786 B1 * 4/2002 Howell et al. ..... 439/342
6,695,635 B1 * 2/2004 Lai ..... 439/342
6,835,072 B2 * 12/2004 Simons et al. ..... 439/66
2006/0178021 A1 * 8/2006 McHugh et al. ..... 439/73

FOREIGN PATENT DOCUMENTS

TW 470224 12/2001

* cited by examiner

*Primary Examiner*—Edwin A. Leon
*Assistant Examiner*—Vanessa Girardi
(74) *Attorney, Agent, or Firm*—Andrew C. Cheng; Wei Te Chung; Ming Chieh Chang

(57) ABSTRACT

An electrical connector includes a frame (2) defining a substantially rectangular configuration and header and rear portions (22), a cover (3) moveably disposed on the frame and including a supporting surface (31) with a plurality of holes (311) defined therein, a lever (4) having a cam portion (42) disposed on the rear portion of the frame to drive the cover to move from a first position to a second position, a base (1) disposed within the frame and under the cover and an engaging member (6) retained in one side of the frame. The engaging member defines an engaging portion (63) at one end thereof which can engage with the lever when the lever arrives at a vertical position relative to the base.

12 Claims, 6 Drawing Sheets

SOCKET CONNECTOR HAVING LEVER-ENGAGING MEMBER

BACKGROUND OF THE INVENTION

1. Field of the Invention

The present invention relates to a socket connector, and more particularly to a ZIF (zero-insertion-force) connector having a base detachably assembled with a metal frame for easily facilitating installation of the base onto a printed circuit board.

2. Description of the Related Art

The IC packages are more and more popular in the computer industry. As well known, the IC package is commonly connected to a mother board through a socket connector which is directly mountably soldered on the mother board. Taiwan Patent Issued Number 470224 discloses a socket connector including a base, a cover slidably mounted to the base and a lever including an actuation handle and a cam portion joined with each other. The cam portion is received between the base and the cover, and the handle is exposed to one side of the base. When the handle is in a horizontal position, conductive pins of the IC package loaded onto the cover will engage with conductive means of the socket connector and the socket connector is in a closed state. After the lever is driven to a vertical position, the IC package can be easily pulled out from the socket connector.

But this type of the socket connector has a potential disadvantage during the lever is driven to the vertical position. A user is not sure whether the socket connector is in the-open state or not, resulting in damage of the conductive pins of the IC package and the socket connector when the package is pulled out in a condition that the cover is non-completely opening.

Hence, a new design which can protect the conductive pins of an IC package and a socket connector is required.

SUMMARY OF THE INVENTION

Accordingly, an object of the present invention is to provide an electrical connector with lever-engaging member to sure the lever to be in a complete opening state.

In order to achieve the object set forth, An electrical connector includes a frame defining a substantially rectangular configuration and header and rear portions, a cover moveably disposed on the frame and including a supporting surface with a plurality of holes defined therein, a lever having a cam portion disposed on the rear portion of the frame to drive the cover to move from a first position to a second position, a base disposed within the frame and under the cover and an engaging member retained in one side of the frame. The engaging member defines an engaging portion at one end thereof which can engage with the lever when the lever arrives at a vertical position relative to the base.

Other objects, advantages and novel features of the invention will become more apparent from the following detailed description of the present embodiment when taken in conjunction with the accompanying drawings.

DETAILED DESCRIPTION OF THE INVENTION

Figure 1:
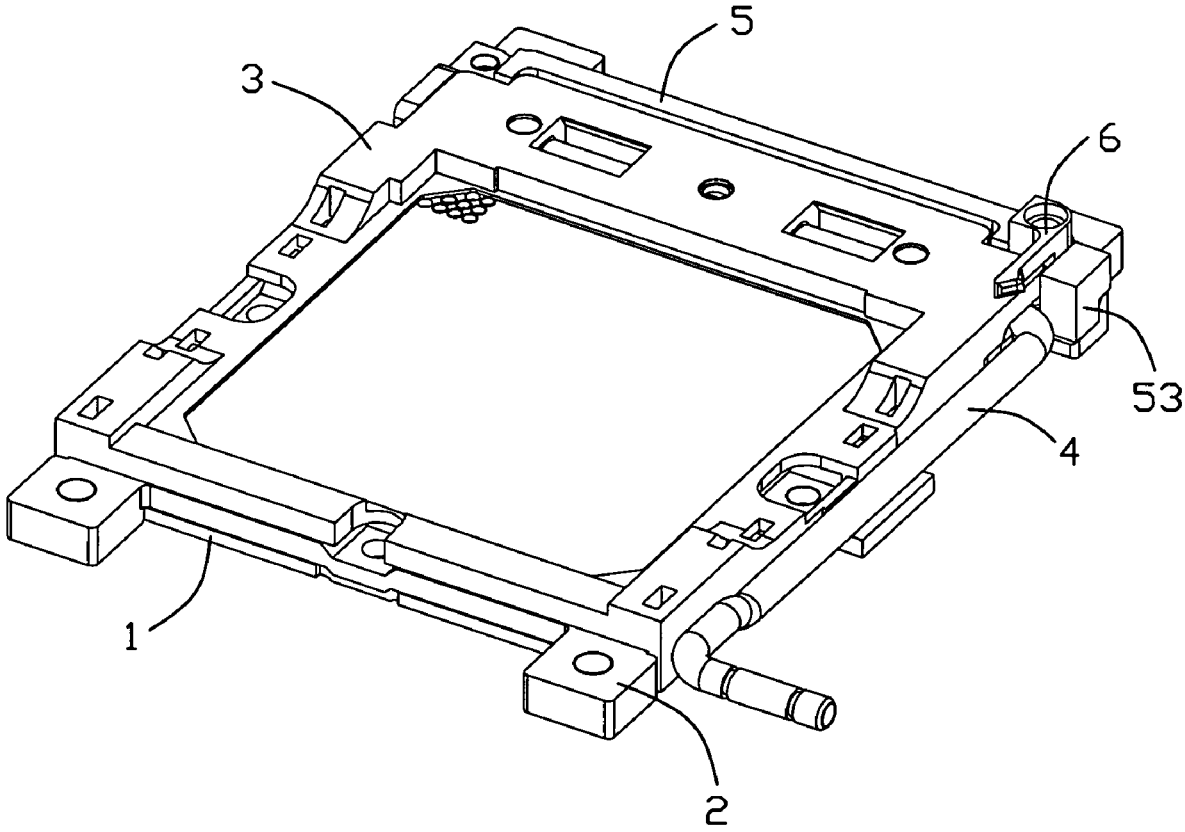
FIG. 1 is a perspective view of an electrical connector in accordance with the present invention, showing the electrical connector in a closed state.

Reference will now be made to the drawing figures to describe a preferred embodiment of the present invention in detail.

Figure 2:
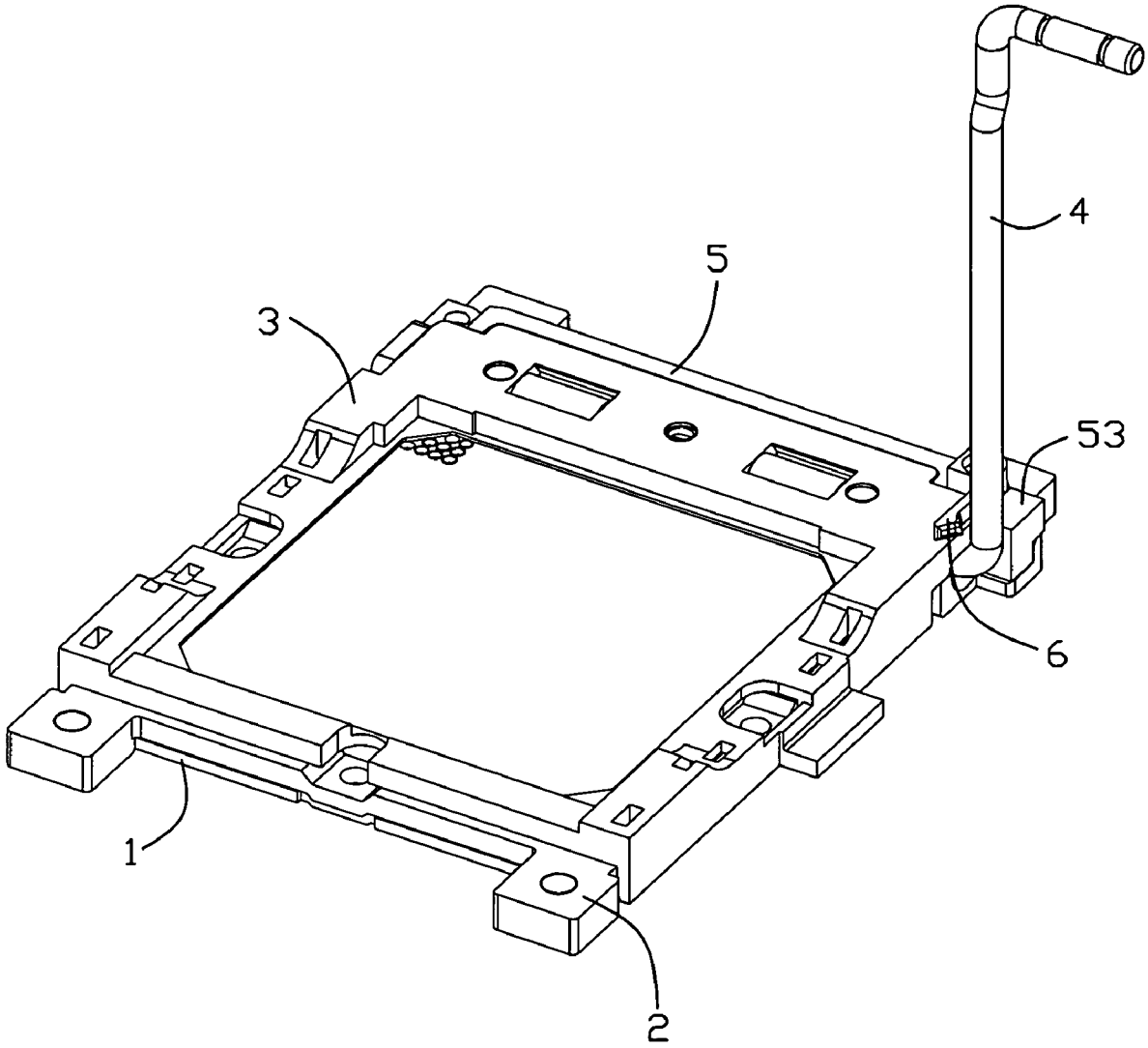
FIG. 2 is a perspective view of the electrical connector shown in FIG. 1, showing the electrical connector in an open state.
Figure 3:
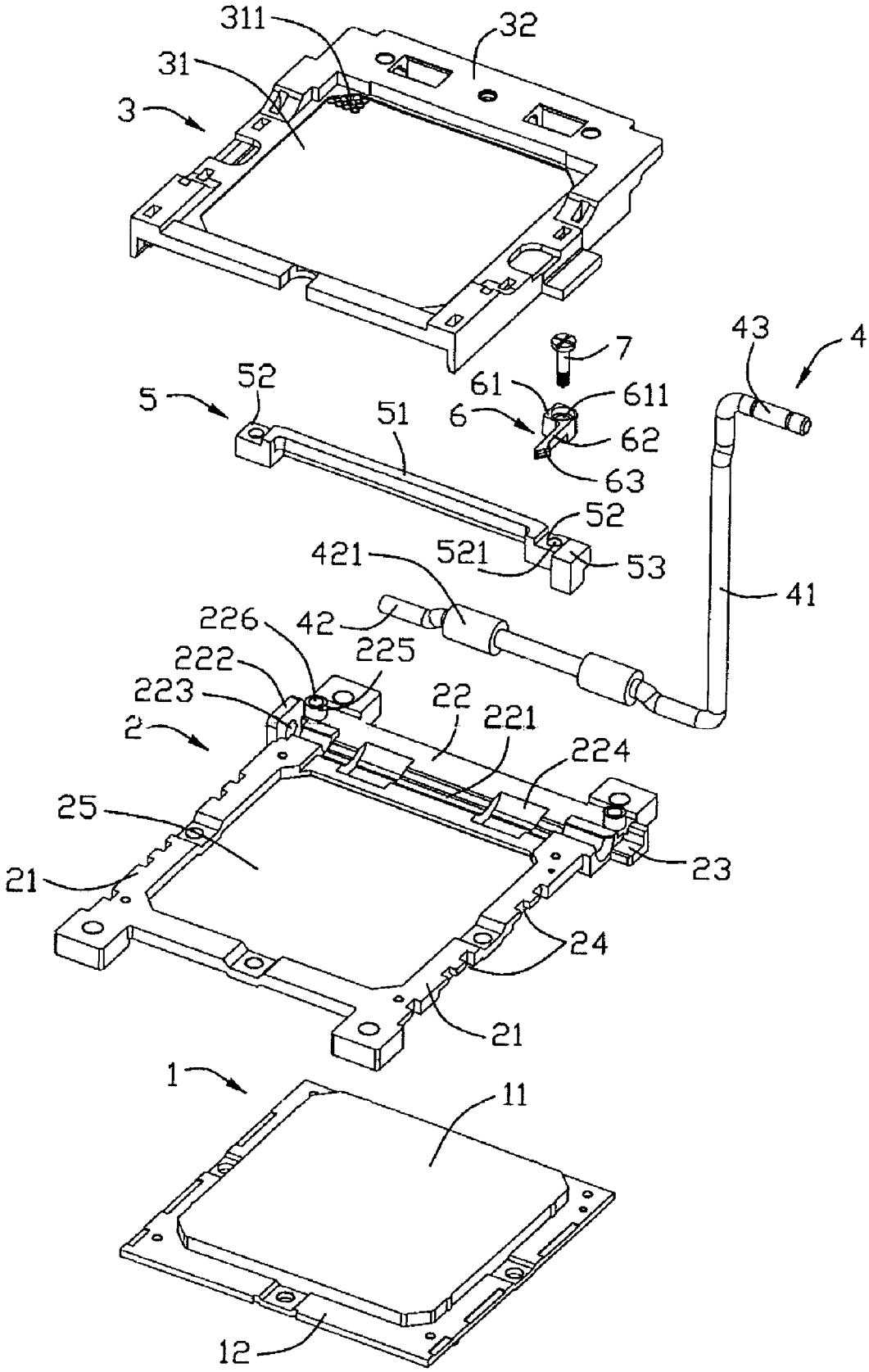
FIG. 3 is an exploded view of the electrical connector shown in FIG. 2.

Referring to FIG. 1 to FIG. 3, an electrical connector for connection of an IC package and a circuit member, includes a base 1 receiving a plurality of terminals therein (not shown), a metal frame 2 assembled on the base 1, a cover 3 movably mounted on the frame 2, a lever 4 retained between the frame 2 and the cover 3 and an engaging member 6 mounted on the frame 2.

Referring to FIG. 3, the plate-like base 1 defines a terminals receiving portion 11 and an installing portion 12 surrounding the receiving portion 11. The receiving portion 11 projects from the center portion of the base 1 and defines a plurality of receiving grooves (not shown) for receiving the terminals. The frame 2 defines two opposite side portions 21 and a third side portion 22 connecting the two side portions 21 at the back portion thereof, the third side portion 22 is defined as a rear portion, the frame 2 further defines a header portion opposite to the rear portion 22. The third side portion 22 defines a larger width than the side portion 21. A first channel 221 opens upwards along a longitudinal direction of the third side portion 22, and two separate communicating recesses 224 are transversely defined in the first channel 221 and open upward. The frame 2 further defines a stopper 222 extending upwardly from one end of the first channel 221, and a through hole 223 runs through the stopper 222. In assembly, the frame 2 is set onto the base 1 with the two opposite side portions 21 and the third side portion 22 mounted on the installing portion 12, and the receiving portion 11 projects into an opening 25 defined in a center portion of the frame 2, as the best shown in FIG. 4. The frame 2 further defines a pair of posts 225 each at one end of the third side portion 22, and each post 225 defines a threaded hole 226 therein.

The lever 4 is an L-shaped and includes a handle 41 and a cam portion 42 joined with each other at a right angle. The cam portion 42 defines a pair of rollers 421. In assembly, the cam portion 42 of the lever 4 is received in the first channel 221 with the free end retained into the through hole 223, and the rollers 421 are received in the corresponding communicating recesses 224, as the best shown in FIG. 4. The handle 41 is located at one side of the frame 2 and has an operating portion 43 perpendicular to one sidewall of the connector.

Referring to FIG. 3, the electrical connector further includes a fixing member 5 assembled to the frame 2. The fixing member 5 defines a base portion 51 and a pair of cubic fixing portions 52 extending from two ends of the base portion 51. A blocking portion 53 extends from one end of the fixing portion 52 and is located in a lower portion 23 which is defined at another end, opposite to the stopper 222 of the frame 2. The engaging member 6 defines a retaining portion 61 and a resilient arm 62 extending forwards from the retaining portion 61. The retaining portion 61 defines a threaded through-hole 611 therein, and the resilient arm 62 defines a protrusion 63 at the free end thereof, the protrusion 63 defined as an engaging portion.

Figure 4:
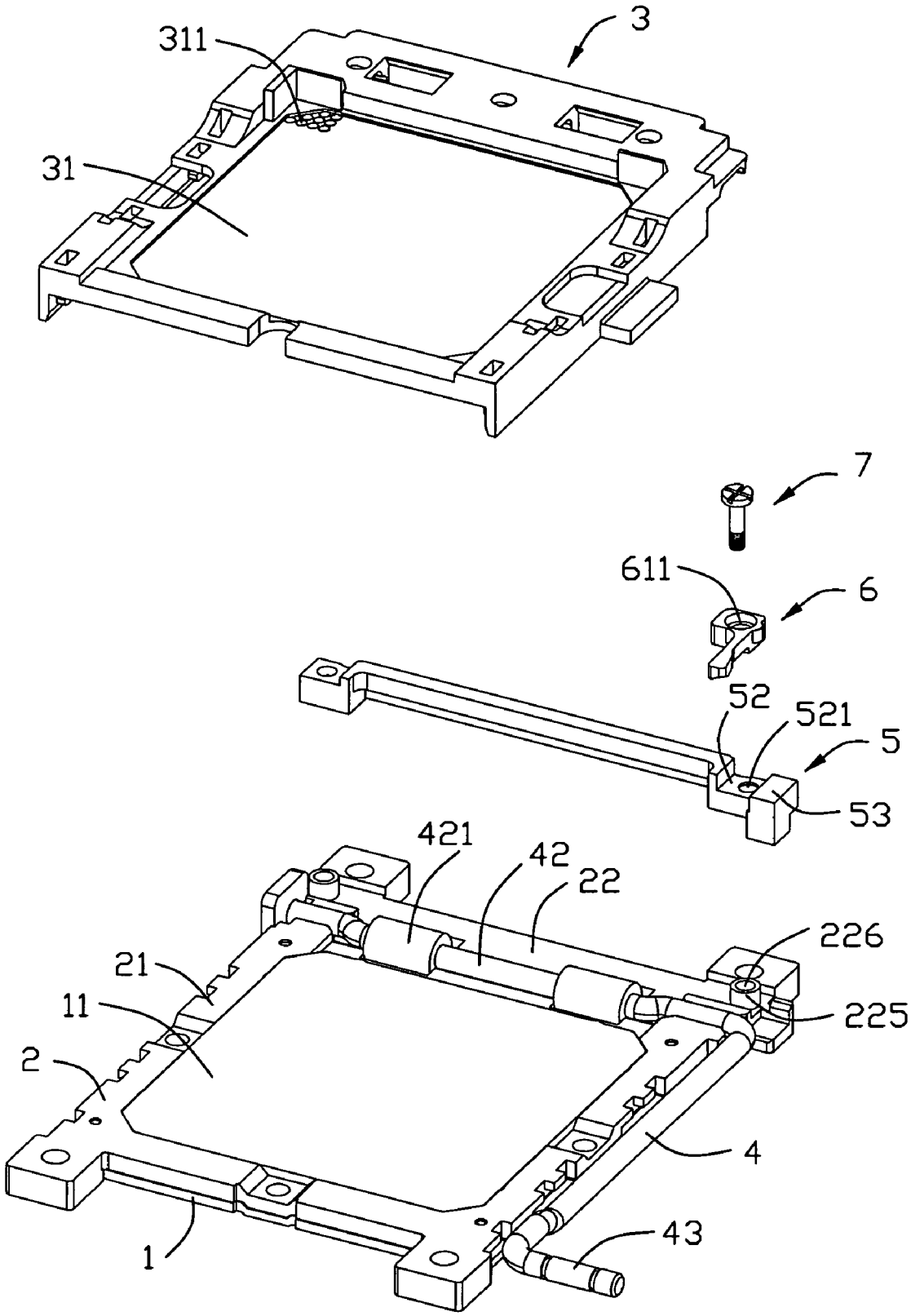
FIG. 4 is a partly exploded perspective view of the connector.
Figure 5:
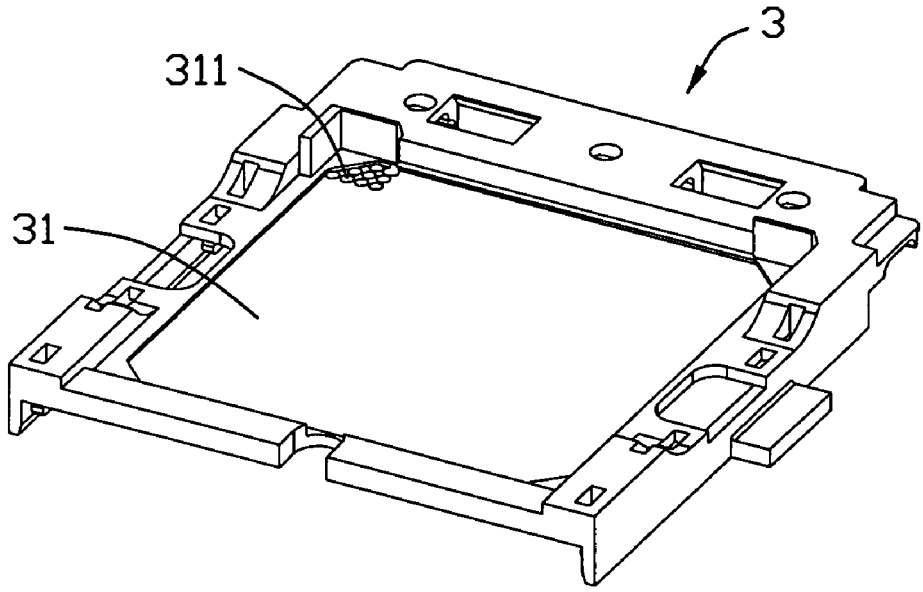
FIG. 5 is another partly exploded perspective view of the connector.
Figure 5:
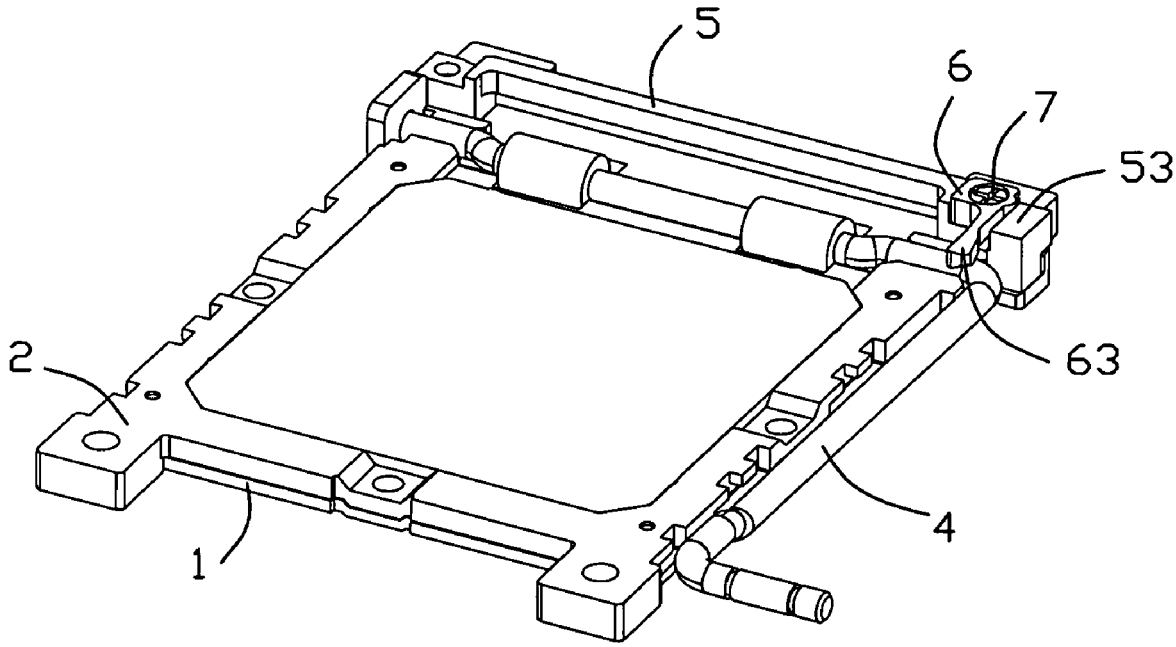

Referring to FIG. 4 and FIG. 5, the fixing member 5 is assembled on the third side portion 22 of the frame 2 with the retaining holes 521 aligned with the corresponding screws 226. The engaging member 6 is arranged on one fixing portion 52 with the threaded through-hole 611 aligned with the retaining hole 521, and a bolt 7 runs through the threaded through-hole 611 and the retaining hole 521, and then twist into the threaded hole 226 to fix the engaging member 6, the fixing member 5 and the frame 2 together, as the best shown in FIG. 5, and the engaging portion 63 is disposed above the joint of the cam portion 42 and the handle 41, and the blocking portion 53 is disposed behind the lever 4.

Figure 6:
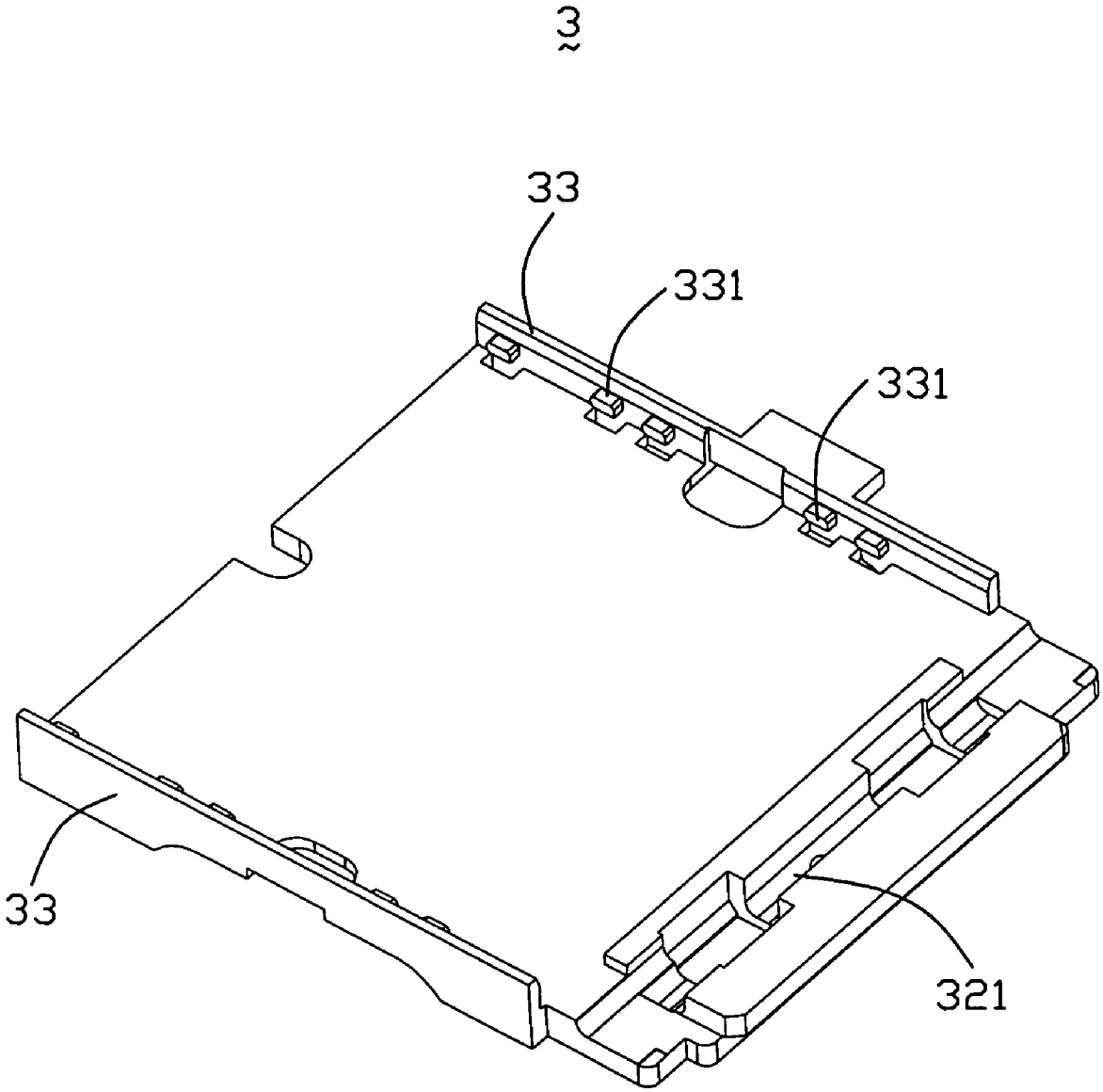
FIG. 6 is another view of the cover shown in FIG. 3.

Referring to FIG. 3 and FIG. 6, the cover 3 defines a supporting surface 31 and a cooperating portion 32. The supporting surface 31 defines a plurality of holes 311 extending vertically therethrough in alignment with the corresponding receiving grooves, respectively, so that the pins, which extend downward from the IC package component (not shown) may project downward through the corresponding holes 311 in the cover 3 and further into the corresponding receiving grooves in the base 1 for mechanically and electrically engagement with the corresponding terminals therein. The cooperating portion 32 includes a second opening-downward channel 321.

In assembly, the cover 3 is retained on the frame 2 with the protrusions 331 defined in a pair of sidewalls 33 retained in the corresponding recesses 24. The cam portion 42 of the lever 4 is received in the first and second channels. The protrusions 331 are movably retained in the corresponding recesses 24 so that the cover 3 can move in a front-to-back direction relative to the base 1.

The pins will mechanically and electrically engage with the terminals received in the base 1 when the handle 41 is in a horizontal position relative to the base 1. During the handle 41 is turned from the horizontal position to a vertical position, the cam portion 42 with the rollers 421 drives the cover 3 to move in a front-to-back direction, the cover 3 moves from a first position to a second position, and the pins are driven from contacting with the terminals. The handle 41 will pass and engage with the engaging portion 63 when the handle 41 arrives at the vertical position, and the users will fell and know that the electrical connector is in the complete-open state. What's more, the handle 41 is retained between the engaging portion 63 and the blocking portion 53 by the engaging portion 63, and the IC package is easy to pull out of the electrical connector and is unlike to damage the pins thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for electrically connecting an integrated circuit to a circuit board, comprising:

a frame including a substantially rectangular configuration and header and rear portions;

a cover moveably disposed on the frame and including a supporting surface with a plurality of holes defined therein;

a lever having a cam portion sandwiched between the rear portion of the frame and the cover to drive the cover to move flatly from a first position to a second position;

a base disposed within the frame and under the cover; and an engaging member retained in one side of the frame, defining a retaining portion, a resilient arm extending from the retaining portion and an engaging portion disposed at a free end of the resilient arm, and the resilient arm and the engaging portion located above the cover;

wherein the engaging portion can engage with the lever when the lever arrives at a vertical position relative to the base.

2. The electrical connector as described in claim 1, wherein the lever defines a handle integrally joined with the cam portion, and the engaging portion engages with the handle when the lever arrives at the second position.

3. The electrical connector as described in claim 1, wherein the retaining portion defines a threaded hole therein, and the engaging member is retained in the frame by a bolt running through the threaded hole and is then fastened into the frame.

4. The electrical connector as described in claim 1, wherein the base defines a receiving portion projecting in an opening defined in the frame.

5. The electrical connector as described in claim 1, wherein the electrical connector further defines a fixing member retained in the frame, the fixing member defines a blocking portion which prevent the lever from further rotating.

6. The electrical connector as described in claim 1, wherein the frame defines two opposite side portions connecting with the rear portion, the two side portions define a plurality of recesses therein, and the cover defines a plurality of protrusions movably retained in the corresponding recesses.

7. The electrical connector as described in claim 1, wherein the rear portion defines a first channel therein.

8. The electrical connector as described in claim 7, wherein the cover defines a second channel therein, and the first channel joins with the second channel to form a full channel enclosing the cam portion.

9. An electrical connector for electrically connecting an integrated circuit to a circuit board, comprising:

a base defining a receiving portion thereof;

a frame assembled on the base, the receiving portion projecting into an opening defined in the frame;

a cover slidably mounted on the base and defining a plurality of holes extending through the cover;

a lever including a handle and a cam portion integrally joined with each other;

the handle being located at one side of the frame, and the cam portion being sandwiched between the frame and the cover; and an engaging member retained in one side of the frame, defining a retaining portion, a resilient arm extending from the retaining portion and an engaging portion disposed at a free end of the resilient arm, and the resilient arm and the engaging portion located above the cover;

wherein the engaging portion engages with the handle when the lever arrives at a vertical position relative to the base.

10. The electrical connector as claimed in claim 9, wherein the resilient aim is located by an interior side of the handle and said engaging portion engages the interior side of the handle.

11. An electrical connector comprising:

a base unit including an insulative central region and a periphery region;

a plurality of terminals disposed in the central region;

an insulative cover attached upon the periphery region and moveable relative to the base unit;

a lever including a cam portion sandwiched between the periphery region and the cover around rear portions of both said periphery region and the cover, and an operation portion linked to one end of said cam portion and moveable in essentially a vertical plane from a horizontal position to an upright position; and an engagement member being discrete from both said cover and said base unit, and attached to at least one of the rear portions of the periphery region and the cover;

wherein said engagement member includes a deflectable aim with thereon a locking head which is engaged with the operation portion when said operation portion is moved to the upright position; wherein the deflectable arm and the associated locking head are located above the cover.

12. The electrical connector as claimed in claim 11, wherein the deflectable arm is located by an interior side of the operation portion and said locking head engages the interior side of the operation portion.

* * * * *